US008181369B2

(12) United States Patent
Nathamuni Balaji et al.

(10) Patent No.: US 8,181,369 B2
(45) Date of Patent: May 22, 2012

(54) SOLEPLATE FOR AN IRON

(75) Inventors: Vignesh Nathamuni Balaji, Chennai (IN); Yong Jiang, Singapore (SG); Pieter Johannes Werkman, Drachten (NL); Maarten Van Den Boogaard, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 526 days.

(21) Appl. No.: 12/444,404

(22) PCT Filed: Oct. 2, 2007

(86) PCT No.: PCT/IB2007/053994

§ 371 (c)(1), (2), (4) Date: Apr. 6, 2009

(87) PCT Pub. No.: WO2008/044166

PCT Pub. Date: Apr. 17, 2008

(65) Prior Publication Data

US 2010/0107457 A1 May 6, 2010

(30) Foreign Application Priority Data

Oct. 9, 2006 (EP) ..... 06121944

(51) Int. Cl.
*D06F 75/38* (2006.01)
*D06F 75/40* (2006.01)

(52) U.S. Cl. ..... 38/97; 38/93

(58) Field of Classification Search ..... 38/74, 77.3, 38/77.6, 77.82, 77.83, 80, 81, 88, 93, 97
See application file for complete search history.

(56) References Cited

U.S. PATENT DOCUMENTS

| | | | | | |
|---|---|---|---|---|---|
| 3,269,040 | A * | 8/1966 | Dikoff | 38/97 |
| 3,721,026 | A * | 3/1973 | McCallum | 38/75 |
| 3,906,187 | A * | 9/1975 | Turoczi, Jr. | 219/254 |
| 4,893,422 | A * | 1/1990 | Mahlich et al. | 38/77.3 |
| 5,592,765 | A * | 1/1997 | Oomen et al. | 38/93 |
| 7,661,212 | B2 * | 2/2010 | Hahn | 38/81 |
| 2004/0172868 | A1 * | 9/2004 | Boulud et al. | 38/93 |

FOREIGN PATENT DOCUMENTS

| | | | |
|---|---|---|---|
| EP | 1593774 | A2 | 11/2005 |
| GB | 2333302 | A | 7/1999 |
| JP | 09056997 | | 3/1997 |
| WO | 0175211 | A2 | 10/2001 |
| WO | 02066728 | A2 | 8/2002 |

OTHER PUBLICATIONS

Tim Somheil; "60 Years of Appliance Technology", Appliance Magazine, Jun. 2004, pp. 1-13.

* cited by examiner

*Primary Examiner* — Ismael Izaguirre

(57) ABSTRACT

The invention relates to an iron (1) comprising a soleplate (3) having a garment-contact surface (5) and having a means for accommodating an antimicrobial agent. By contacting the garment-contact surface with the piece of garment, as is being done during ironing, the antibacterial agent is transferred to the garment. The antimicrobial agent is disposed on the garment by simply placing the iron on the garment and moving it over the garment surface. The garment stays fresher for a longer period of time. The invention further relates to a soleplate, a steam ironing device and methods of manufacturing an iron and a soleplate, respectively.

12 Claims, 3 Drawing Sheets

SOLEPLATE FOR AN IRON

FIELD OF THE INVENTION

The invention relates to an iron comprising a soleplate having a garment-contact surface and having a means for accommodating an antimicrobial agent. The invention further relates to a soleplate, a steam ironing device, and a method of manufacturing an iron and a method of manufacturing a soleplate.

DESCRIPTION OF THE PRIOR ART

An embodiment of the above-described iron is known from JP-09056997.

JP-09056997 discloses a steam iron comprising a main body and a base equipped with a heater and a steam-jetting hole and a predetermined amount of water and an antibacterial member provided in a water feed tank. By jetting steam containing the antibacterial member from the lower surface of the iron base the antibacterial member is applied to clothing.

The user has to fill and refill the water feed tank of such an iron with water and the antimicrobial agent to ensure the availability of the antimicrobial agent. This may be cumbersome and there is a risk of spilling water and/or the antibacterial member.

SUMMARY OF THE INVENTION

It is an object of the invention to provide an iron capable of providing an antimicrobial agent to a piece of garment without the requirement of refilling the iron with an antimicrobial agent.

The object is achieved by an iron wherein the means for accommodating the antimicrobial agent is formed at least by the garment-contact surface accommodating the antimicrobial agent, which garment-contact surface is capable of transferring the antimicrobial agent to a piece of garment.

The iron according to the invention is defined in claim 1.

The soleplate is provided with the garment-contact surface accommodating the antimicrobial agent. By contacting the garment-contact surface with the piece of garment, as is being done during ironing, the antibacterial agent is transferred to the garment.

Surprisingly, it has been found that the antimicrobial agent is provided on the garment by simply placing the iron on the garment and moving it over the garment surface.

This way the antimicrobial agent is administered to a piece of garment without the necessity of a reservoir containing a solution comprising an antimicrobial agent.

The antimicrobial agent has antimicrobial properties; this means that it kills, or slows the growth of, microbes like bacteria (antibacterial activity) and/or fungi (antifungal activity for instance against fungi known as mold) and/or viruses (antiviral activity) and/or parasites in particular on the ironed surface of the piece of garment.

After ironing using the iron according to the invention, the ironed surface of the piece of garment is provided with a quantity of the antimicrobial agent. The ironed surface thus obtained has antimicrobial properties. By ironing a piece of garment with the iron according to the invention the resistance against bacteria, fungi and/or mold is enhanced.

The soleplate of the iron is usually heated by an electric heating element. The temperature of the soleplate is usually kept at a desired value by means of a thermostat and a temperature dial. The number of dots on the temperature dial indicates the temperature of the soleplate's surface:

- 1 dot, on average 110° C., this is the Low setting on most irons,
- 2 dots, on average 150° C., this is the Medium setting on most irons,
- 3 dots, on average 200° C., this is the High setting on most irons.

The iron according to the invention may be used at any point in the temperature range provided by the iron; the temperature of the soleplate may occasionally be as high as about 250° C. The antimicrobial agent accommodated by the iron according to the invention is therefore temperature resistant at such temperatures. A suitable antimicrobial agent being accommodated by the iron shows no degradation after exposure to a temperature of 250° C. for at least 4 hours.

The antimicrobial agent includes, but is not limited to, antimicrobial metal ions. Antimicrobial metal ions are metal ions having antimicrobial properties and—while being accommodated by the iron—show no degradation after exposure to a temperature of 250° C. for at least 4 hours. Suitable examples are silver-, copper-, zinc-, platinum- or selenium ions or a combination thereof. The antimicrobial properties of Ag+ ions are known per se.

Though ironing by itself involves the use of heat and can kill a certain percentage of the bacteria present on the piece of garment during the process of ironing, it doesn't enhance the resistance of garments to e.g. bacteria or fungi. During use of the garment, bacteria start to grow. By ironing a piece of garment, using the iron according to the invention, the antimicrobial agent is deposited over the garment and the garment stays fresher for a longer period of time. In addition to making the garment more hygienic, the ironing soleplate itself, which comprises antimicrobial agents, tends to be cleaner and reduces the growth of bacteria/fungi on the garment-contact surface.

By depositing the antimicrobial agent over the surface of garments the growth of bacteria is prevented or slowed down. Dust mites feed on bacteria on f.i. garments. Preventing or slowing down the growth of bacteria on garments therefore also affects the dust mites on garments: because their bacteria food source is reduced, their growth is also slowed down. Ironing using the iron according to the invention therefore has an anti dust mite effect on the ironed surface.

The amount of antimicrobial agent transferred to the surface of the piece of garment depends, a.o. on the number of ironing strokes that the garment surface received and the amount of antimicrobial agent present at the garment-contact surface of the soleplate. More strokes result in a greater transfer of the antimicrobial agent. A higher concentration of antimicrobial agent at the garment-contact surface results in a greater transfer of antimicrobial agent.

In an embodiment of the iron according to the invention, the garment-contact surface of the soleplate is made from aluminum, aluminum alloy or stainless steel comprising metal ions of silver, copper, zinc, platinum or selenium or a combination thereof.

In a practical embodiment, metal particles such as silver, copper or zinc particles or a combination thereof are incorporated in the aluminum or stainless steel soleplate.

When these metal particles are exposed to oxygen, as is present in the air, conversion of metal to metal oxide occurs spontaneously at the surface of these particles, resulting in the presence of antimicrobial metal ions (in this case silver, copper or zinc ions or a combination thereof) in the soleplate.

Conversion of Ag to $Ag_2O$ occurs spontaneously when Ag is exposed to oxygen present in the air. This conversion occurs slowly. Increasing the temperature increases the speed at which the conversion of the metal to the metal oxide occurs.

During ironing, the temperature of the garment-contact surface is, depending on the setting, usually between on average 110° C. (this is the 1 dot or Low setting on most irons) and on average 200° C. (this is 3 dot or the High setting on most irons). The ironing temperatures are thus very suitable for generating an Ag to $Ag_2O$ conversion and hence for generating Ag+ ions.

During ironing, the antimicrobial metal ion is transferred to the garment by contacting the garment with the garment-contact surface according to the invention. For this transfer some moisture is necessary. An experiment has shown that without the addition of moisture, ironing a dry piece of garment using an iron according to the invention results in transfer of Ag+ from the garment-contact surface to the ironed surface of the garment. Apparently the amount of moisture naturally present in the garment is sufficient for Ag+ to be transferred.

In an embodiment of the iron according to the invention, the antimicrobial agent is selected from a group comprising ions of silver, zinc, copper, selenium, platinum or a combination thereof.

In an embodiment of the iron according to the invention, the soleplate is made from a material comprising at least 0.05 weight percent of the antimicrobial agent.

In another embodiment, the soleplate comprises 0.1-35 weight percent of the antimicrobial agent, based on the weight of the antimicrobial agent.

The antimicrobial agent may be present as particles, the particles preferably having an average size in a range of 1 nm-1 micron.

The transfer of the antimicrobial agent requires surface contact between the garment-contact surface comprising the antimicrobial agent of the soleplate and the garment article that is being ironed. In case the antimicrobial agent is present as particles or as part of a particle, the transfer is more effective when the surface area of these particles is relatively large. Small particles of for example silver, zinc, copper, selenium or platinum have surface areas that are relatively large as compared to larger particles. In an embodiment of the iron according to the invention, the soleplate comprises particles of silver, zinc, copper, selenium or platinum, or a combination thereof, having an average size in a range of 1 nm-500 nm, preferably 10-200 nm. A suitable choice is HyGate™ nano silver from Bio Gate AG (Germany), available as a product having an average silver particle size of 5-50 nm and as a product having an average silver particle size of 50-200 nm.

In an embodiment of the iron according to the invention, the means for accommodating the antimicrobial agent comprises a layer comprising the antimicrobial agent, the garment-contact surface being a surface of the layer.

In such an embodiment, the soleplate is provided with a layer comprising the antimicrobial agent, the layer comprising the garment-contact surface. In this embodiment the layer comprises the antimicrobial agent, i.e the soleplate itself doesn't have to comprise the antimicrobial agent. In this way the amount of antimicrobial agent per soleplate and thus per iron may be reduced.

Layers having a thickness in a range of 0.5-250 micron have been found suitable.

The layer may be a metal layer, preferably silver, copper, a copper-alloy or zinc. When such a metal layer is exposed to oxygen, as is present in the air, conversion of metal to metal oxide occurs spontaneously at the surface or these particles, resulting in the presence of antimicrobial metal ions (in this case silver, copper or zinc) in the layer on the soleplate.

A suitable way to obtain such a layer is by sputtering the metal on the soleplate; in this way typically a layer having a thickness of 0.5-3 micron can be obtained.

Alternatively, the metal layer is rolled onto the soleplate. In this way a soleplate having a metal layer having a thickness in a range of 150-250 micron can be obtained.

Alternatively, the layer comprises a thermoplastic polymer, a sol-gel or an enamel material comprising the antimicrobial agent.

Suitable thermoplastic polymers are thermally stable polymers such as silicones, polyimides, polyamide imide, polyether amide, polyether sulfone, polyether ether ketone, polyphenyl sulfide polysulfone and polytetra fluoro ethylene.

The layer may be a sol-gel coating comprising the antimicrobial agent and having a thickness in the range of 5-100 micron.

In an embodiment of the iron according to the invention, the layer comprises at least 0.5 weight percent of the antimicrobial agent.

In another embodiment, the layer made of thermoplastic polymer, sol-gel or enamel material comprises 0.5-35 weight percent of the antimicrobial agent.

The antimicrobial agent is transferred more readily when the surface on which the antimicrobial agent is present is larger. A carrier may help to enhance the surface over which the antibacterial agent is spread, thus facilitating the release of the antimicrobial agent.

In an embodiment of the iron according to the invention, the layer comprises a carrier comprising the antimicrobial agent. In a particular embodiment the carrier is a zeolite. Zeolite is an inorganic, ceramic material that is open and porous in structure and has a large zeolite surface. The zeolite carrier comprises ions of silver, copper or zinc or a combination thereof on this zeolite surface.

Good results were obtained using silver ions residing within a lattice of the zeolite. A suitable carrier comprising a suitable antimicrobial agent is commercially available as AgION® (by AgION antimicrobial technologies Inc.). Alternatively, AgION® Silver Copper Zeolite may for instance be used.

AgION® antimicrobial compound is an inorganic antimicrobial system comprising an active ingredient—silver ions—and an inert mineral delivery material known as zeolite. AgION® combines silver's antimicrobial properties with zeolite to form an ion-exchange delivery system. The bonding of the silver to zeolite ensures continuous, controlled release of the metal over a long period. This results in a long-lasting, on-demand, antimicrobial effect that destroys bacteria and suppresses future contamination. When moisture is present, ion exchange occurs. The silver ions are released from the AgION® compound and exchanged with ions in the environment.

The moisture may be present by ironing a wet or moist piece of garment. The piece of garment may be wet because it has been washed and not fully dried, sprayed with water to moisten it or for instance by using steam from a steam iron comprising a soleplate according to the invention.

Embodiments of the iron according to the invention are defined in claims 2 to 9.

The soleplate according to the invention comprises a garment-contact surface and has a means for accommodating an anti-microbial agent, which means is formed at least by the garment-contact surface accommodating the antimicrobial agent, which garment-contact surface is capable of transferring the antimicrobial agent to a piece of garment. The soleplate according to the invention has the same benefits as the iron mentioned above.

The steam ironing device according to the invention comprises a steam-generating means and an iron according to the invention, wherein the sole plate comprises at least one opening and the steam-generating means is arranged for delivering steam to the opening.

In a conventional steam iron, steam is generated by a steam generating means, which comprises a water reservoir and a steam chamber. Usually, a water-dosing pump is provided to pump the water from the water reservoir to the steam chamber (as drops rather than a large flow of water). The water may be pumped via a hose under command of a pump signal from an electric control device. The rate at which water is supplied dictates the amount of steam being produced, and the amount of steam is sufficiently small that the temperature of the sole plate is not significantly affected.

Instead of a pumped system, water can be dosed to the steam chamber under gravity.

The steam chamber is typically heated by the sole plate, but an auxiliary heating element may instead be provided.

The steam from the steam chamber reaches a steam outlet opening or openings provided in the sole plate of the iron.

Some moisture is needed to transfer antibacterial metal ions such as silver-, copper-, zinc-, platinum- or selenium ions or a combination thereof. As indicated above, an experiment has shown that without addition of moisture, ironing a dry piece of garment using an iron according to the invention results in transfer of Ag+ from the garment-contact surface to the ironed surface of the garment. Apparently, the amount of moisture naturally present in the garment is sufficient for Ag+ to be transferred.

The amount of moisture present at the garment surface may for instance be increased by spaying water on the garment or by providing steam to the garment. Water may for example be sprayed using a flask which contains water and which is equipped with a sprayer or by using a water sprayer which may be present on the iron.

Steam may for example be provided to the garment surface by a steam ironing device or a steamer during use or by hanging the garment in a damp room, such as the bathroom after somebody has taken a shower. Using the steam ironing device is an easy way to further facilitate the transfer of metal ions from the garment-contact surface of the soleplate of the iron to the garment surface. While being ironed using the steam function on the iron, the garment surface is moistened by the steam and contacted by the garment-contact surface comprising the antimicrobial agent of the iron at the same time.

The steam ironing device as such is well-known in practice. The steam ironing device may be a steam iron or a so-called boiler ironing system. The boiler ironing system comprises a steam iron having a soleplate with a soleplate surface and a boiler for heating water which is arranged separately from the steam iron, wherein the water tank is attached to a stand comprising the boiler. In many cases, the water tank is removably arranged, so that a user of the device comprising the water tank is capable of taking the water tank to a tap or the like in order to fill the water tank, without having to move the entire device.

In an embodiment of the steam ironing device according to the invention, the steam generating means comprises a steam chamber.

In another embodiment of the steam ironing device according to the invention, the steam generating means comprises a boiler.

The steam generating means may be housed by an ironing board.

The method according to the invention for manufacturing a soleplate having a garment-contact surface and a layer comprising an antimicrobial agent, the layer having a garment-contact surface capable of transferring the antimicrobial agent to a piece of garment, comprises the step of providing the layer comprising an antimicrobial agent to a soleplate.

The method according to the invention for manufacturing an iron comprising a soleplate having a garment-contact surface, the soleplate having a means for accommodating an antimicrobial agent, wherein the means comprises the garment-contact surface accommodating the antimicrobial agent, which garment-contact surface is arranged for transferring the antimicrobial agent to a piece of garment, the method comprising the step of providing the antimicrobial agent to the soleplate.

A way to execute one of the methods according to the invention as defined in claims 12 and 13 is to apply a polymer layer comprising the antimicrobial agent to the soleplate.

Suitable thermoplastic polymers are thermally stable polymers such as silicones, polyimides, polyamide imide, polyether amide, polyether sulfone, polyether ether ketone, polyphenyl sulfide polysulfone and polytetra fluoro ethylene.

Another way to execute these methods according to the invention is to apply a sol-gel coating comprising the antimicrobial agent to the soleplate and cure the soleplate thus obtained.

Applying a sol-gel coating as such is known per se, but for the manufacture of a soleplate it typically comprises steps such as:

1) providing a sol-gel solution,
2) spraying this sol-gel solution onto the ironing plate,
3) drying the sol-gel layer thus obtained, e.g. by heating the ironing plate; this way solvent is evaporated, leaving behind a gel network,
4) curing the gel by heating.

The steps 3 and 4, i.e. drying and subsequent curing, are usually combined in one curing step.

A way to execute the methods according to the invention is to admix the antimicrobial agent to the sol-gel solution in step 1 mentioned above.

In another way to execute the methods according to the invention, a known sol-gel solution is applied to the soleplate, and on top of this known sol-gel solution an antimicrobial agent is applied e.g. by spraying a solution comprising the antimicrobial agent. The thus obtained soleplate is cured. In this embodiment the antimicrobial agent is sprayed after step 2 (see above) onto the wet sol-gel layer and penetrates at least partly into the wet sol-gel layer, the thus obtained two-part layer is cured (steps 3 and 4). The antimicrobial agent in this embodiment is present in a very thin layer that may have a thickness in a range of 0.5-1.5 micron.

In a practical embodiment of the method according to the invention, as defined in claim 13, metal particles such as silver, copper or zinc particles or a combination thereof are incorporated in the aluminium or stainless steel soleplate.

The invention also includes any possible combination of features or subject matter as claimed in any one of the claims.

BRIEF DESCRIPTION OF DRAWINGS

The invention will now be described, by way of example, with reference to the accompanying drawings. In principle, aspects can be combined.

DETAILED DESCRIPTION OF DRAWINGS

Figure 1:
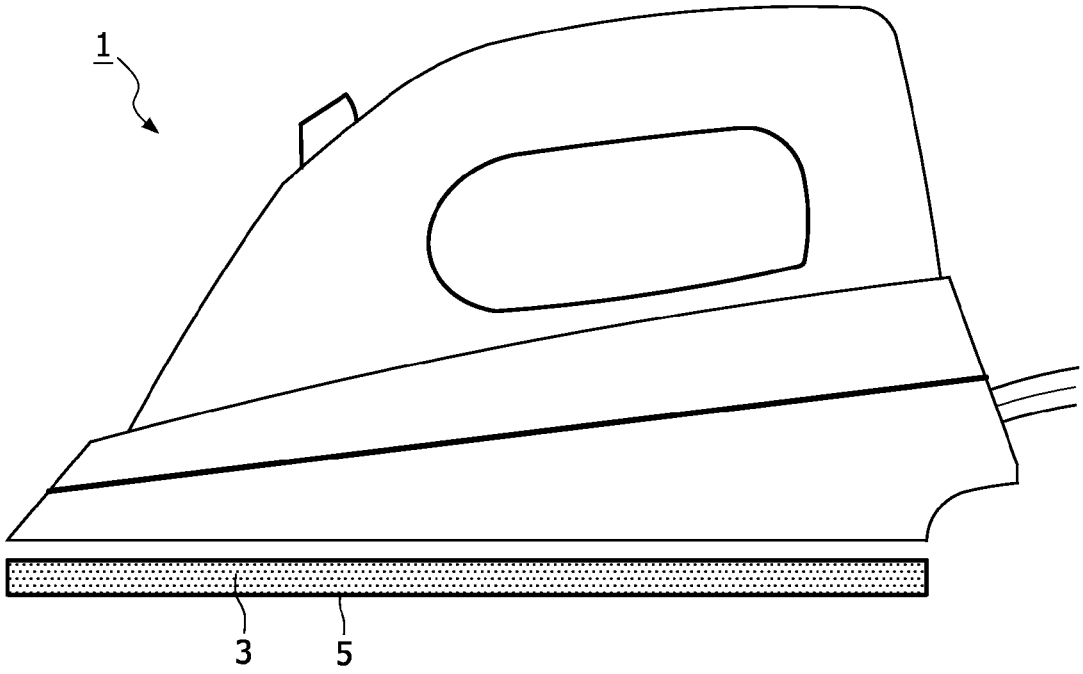
FIG. 1 schematically depicts a first embodiment of the iron according to the invention.

In FIG. 1 the first embodiment of the iron according to the invention is schematically depicted. The iron 1 comprises a soleplate 3 having a garment-contact surface 5. The soleplate comprises an antimicrobial agent. By contacting the garment-contact surface 5 with the piece of garment, as is being done during ironing, the antimicrobial agent is transferred to the piece of garment. A water sprayer (not shown) may be provided to moisten the garment and—in case the antimicrobial agent is transferred in the presence of water—to facilitate transfer of the antimicrobial agent.

Figure 2:
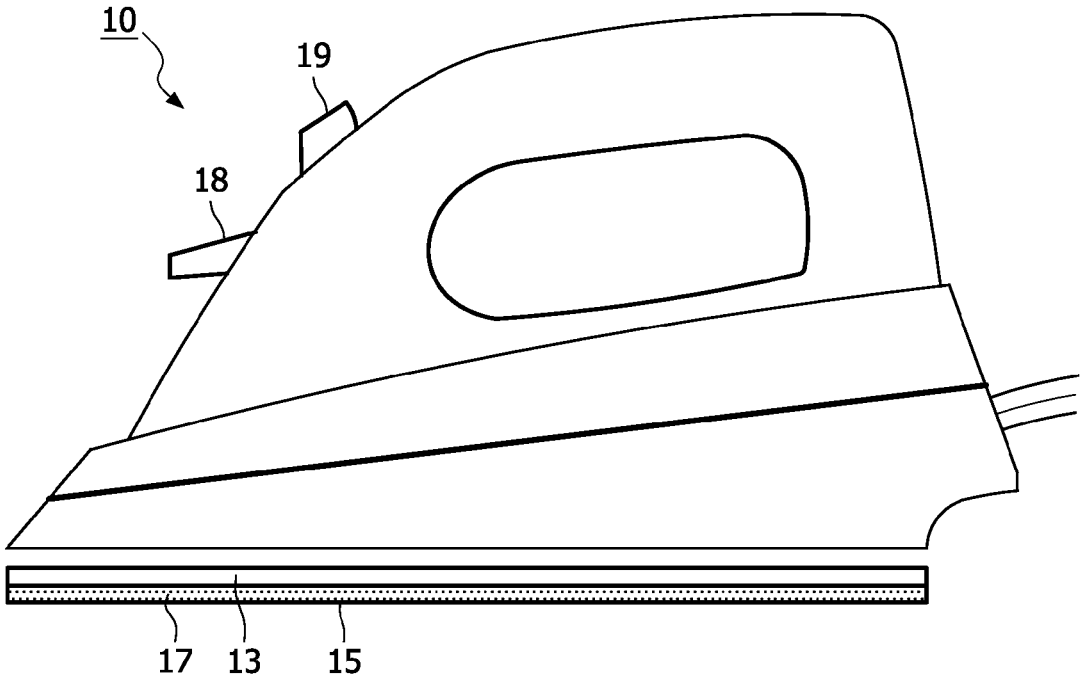
FIG. 2 schematically depicts a second embodiment of the iron according to the invention.

In FIG. 2 the second embodiment of the iron according to the invention is schematically depicted. The iron 10 comprises a soleplate 13 provided with an antimicrobial layer 17 comprising an antimicrobial agent. The layer 17 has a garment-contact surface 15. The iron further comprises a means for supplying water to the fabric to be ironed. This water-supply means comprises a depressable water trigger 19 and a water sprayer 18 connected to a water reservoir (not shown).

For transfer of ions, such as silver, copper, zinc, platinum, selenium ions or a combination thereof, moisture is needed. Experiments have shown that even without adding water, silver ions were transferred from the garment-contact surface to the surface of the piece of garment.

In case the antimicrobial agent is transferred more effectively in the presence of water, the user may activate the water trigger 19 to spray water from the sprayer to the piece of garment to moisten it.

Figure 3:
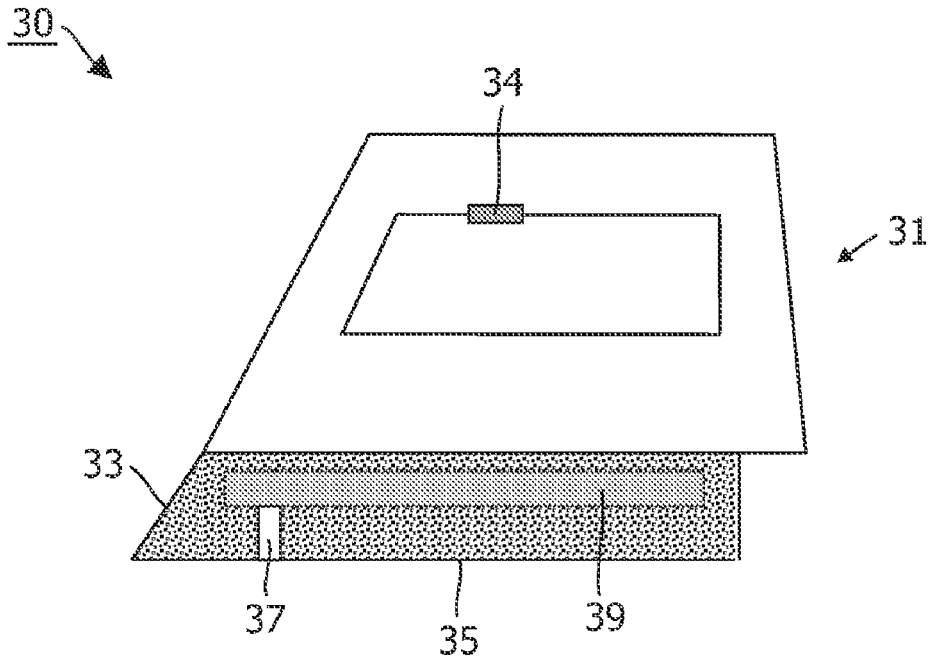
FIG. 3 schematically depicts a first embodiment of the steam ironing device according to the invention.

In FIG. 3 the first embodiment of the steam ironing device according to the invention is schematically depicted. This device is provided with a steam iron 30 comprising a soleplate 33 comprising an antimicrobial agent and having a steam-outlet opening 37. The soleplate 33 has a garment-contact surface 35. The steam iron 30 further comprises a means for generating steam. The steam generating means comprise a steam chamber 39 and a water reservoir (not shown).

In case the antimicrobial agent is transferred in the presence of water, the user may use steam during ironing, for instance, by activating a steam trigger 34 arranged for cooperation with the steam-generating means. The steam-generating means is arranged for providing steam via the opening 37 to the piece of garment to be ironed and to be treated with the antimicrobial agent.

A water sprayer (not shown) may be provided to moisten the garment and—in case the antimicrobial agent is transferred in the presence of water—to facilitate transfer of the antimicrobial agent.

Figure 4:
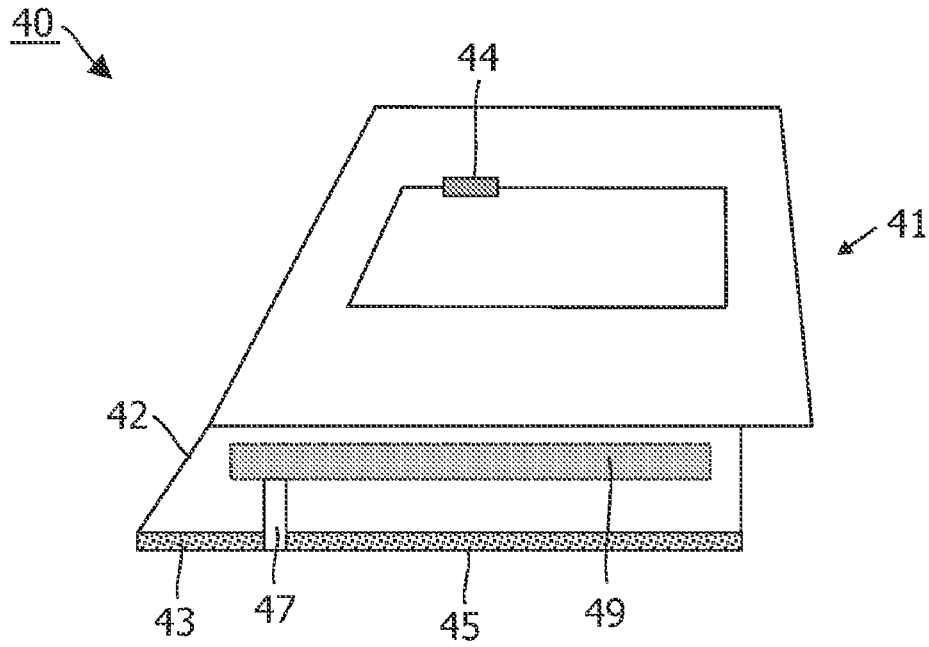
FIG. 4 schematically depicts a second embodiment of the steam ironing device according to the invention.

In FIG. 4 the second embodiment of the steam ironing device according to the invention is schematically depicted. This device is provided with a steam iron 40 comprising a soleplate 42 provided with a layer 43 comprising an antimicrobial agent and having the steam outlet opening 47. The layer 43 comprises the garment-contact surface 45.

The steam iron 40 further comprises a means for generating steam. The steam generating means comprises a steam chamber 49 and a water reservoir (not shown).

In case the antimicrobial agent is transferred in the presence of water—for example if AgION® is used—the user may use steam during ironing, for instance, by activating a steam trigger 44 arranged for cooperation with the steam-generating means. The steam-generating means is arranged for providing steam via the opening 47 to the piece of garment to be ironed and to be treated with the antimicrobial agent. A water sprayer (not shown) may be provided to moisten the garment.

Figure 5:
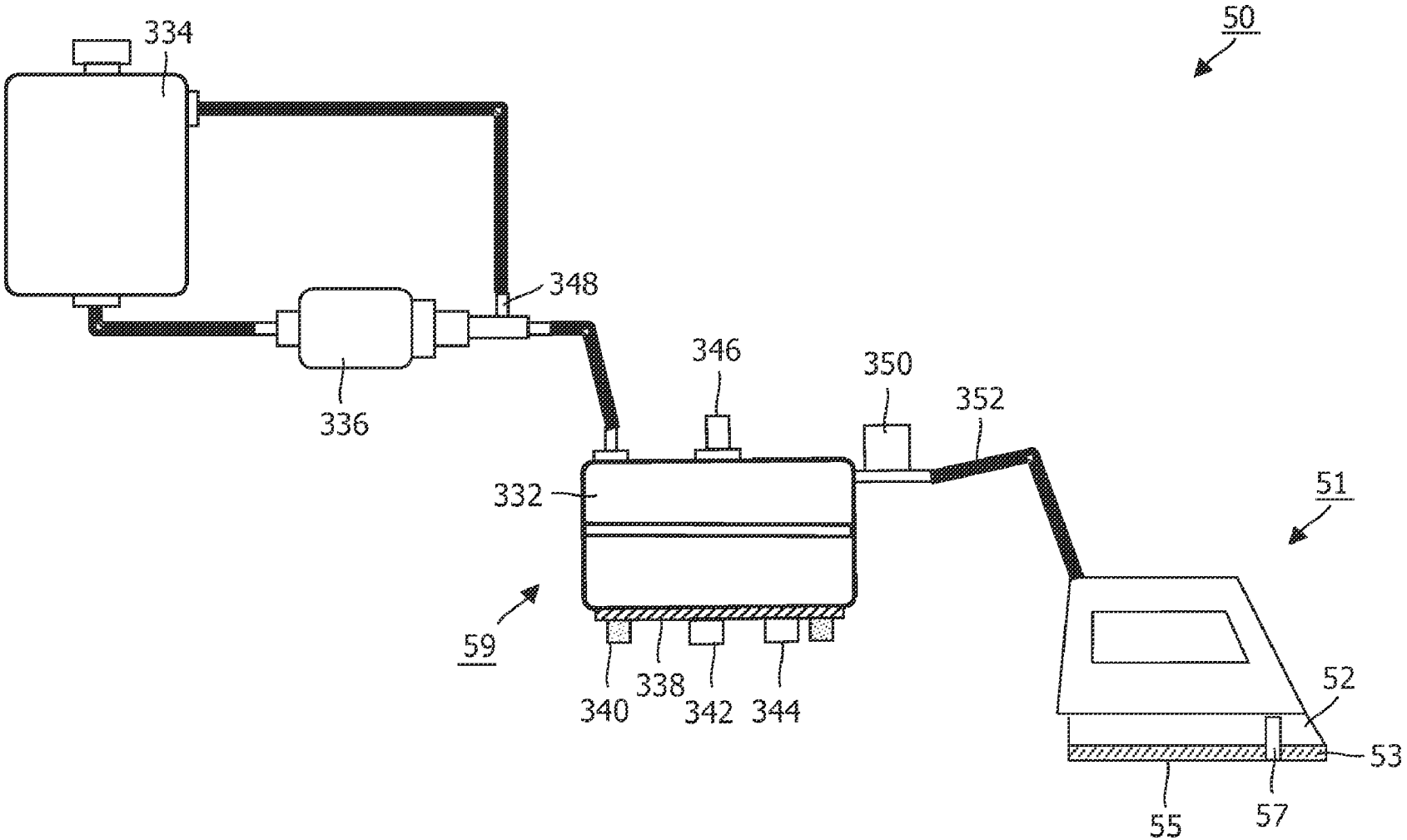
FIG. 5 schematically depicts a third embodiment of the steam ironing device according to the invention.

In FIG. 5 the third embodiment of the steam ironing device according to the invention is depicted.

The steam ironing device 50 in this embodiment is the so-called boiler ironing system. In such a system a steam-generating means 59 comprises a boiler 332 for heating water, which is arranged separately from a steam iron 51 according to the invention, and a water tank 334. The boiler 332 comprises a heating plate 338 connected to a heating element 340. An electro valve 350 is arranged that opens to let steam pass via a steam delivery hose 352 to the iron 51. The boiler usually further comprises a pressure sensor 342 to measure the pressure inside the boiler, a water-level sensor 344 and a safety valve 346 that opens if the pressure inside the boiler 332 is too high, i.e. above a certain set value. To fill the boiler, water is pumped by a water pump 336 from the water tank 334 to the boiler 332. A de-airing valve 348 may be present to let air out of the water.

The steam ironing device 50 comprises the iron 51 according to the invention having a soleplate 52. An antimicrobial layer 53 is provided onto the sole plate 52 of the iron 51. The antimicrobial layer 53 comprises a garment-contact surface 55. The sole plate 52 of the iron comprises a steam-outlet opening 57.

EXPERIMENTS

To illustrate the effect of selecting a certain antimicrobial agent, the following examples are given hereinafter:

REFERENCE

A soleplate of an aluminum alloy was first degreased in a suitable detergent and subsequently etched in an acidic solution, such as nitric acid, or in alkaline solution, such as sodium hydroxide, in order to activate and clean the surface.

Thereafter the soleplate was rinsed with tap water and deionised water and during a known electrochemical process, e.g. disclosed in WO 02/066728, the ironing plate was provided with a porous layer of aluminum oxide. The porous aluminum oxide layer acts as a primer layer to provide for good adhesion of a polymer layer.

After pre-treatment of the aluminum soleplate, the following steps were executed.

A sol-gel basic coating was applied on top of the porous aluminum oxide layer. On top of the basic coating an ethanol-based sol-gel top coating was applied. Subsequently, the plate was dried and cured. In this way, sol plate S1 was obtained; the basic coating had a thickness of about 23 micrometer and the sol-gel top coating had a thickness of about 10 micrometer.

Example 1

The manufacturing steps of the reference soleplate were followed, according to which, after applying the sol-gel top coating, a 2.5 wt % AgION® ethanol solution was sprayed on top of the wet top coating (2.5 wt % AgION® comprises 0.06 wt % Ag+). Subsequently, the plate was dried and cured. In this example the antimicrobial agent is sprayed onto the wet, sol-gel top coat layer and penetrates at least partly into this wet sol-gel layer; the thus obtained two-part layer is cured. It was estimated that the antimicrobial agent in this example had penetrated about 1 micron into the sol-gel topcoat of about 10 micron. This way soleplate S2 was obtained.

Example 2

The steps for the manufacturing of the reference soleplate were followed, according to which the mixture of the sol-gel top coating is admixed with an AgION® ethanol solution (ratio of 30:70% by weight). In this way an antibacterial sol-gel mixture is obtained comprising approximately 8% AgION®.

Because the sol-gel mixture is alcohol-based, an alcohol-compatible AgION® powder was used.

A skilled person may select a different weight ratio, if preferred.

Subsequently the plate was dried and cured. This way soleplate S3 was obtained, this soleplate had an antimicrobial topcoat layer of about 10 micron in thickness.

Example 3

A water-based AgION® slurry is mixed with a Teflon™ (by Du Pont)-based Ceralon (by Whitford) coating.

This 2.5% by weight solid AgION® mixture is applied on top of the aluminum soleplate by spraying. The Ceralon coating is a water-based coating; in order to obtain a mixture, water-based AgION® (slurry) was used. The layer thus obtained was dried and cured. In this way soleplate S4 was obtained.

Ironing Tests

Sole plates S1-S3 were used on Azur irons from Philips.

Sole plate S4 was used on a Mistral iron from Philips.

All irons used are steam irons, the steaming function was however turned off in some experiments.

All samples described were tested in one run.

Pieces of standard cloth (each cut from the same moiré fabric of 0.4 g/m) were cut, (approximately 13.5×approximately 66.5 cm) and were subjected to the following treatments:

1) Washing;
2) Ironing using one of the soleplates 1-4 prepared as described above;
3) After 3 days the pieces of cloth were inoculated with *Staphylococcus Aureus* bacteria. This was carried out by applying the inoculum to the cloth (According to ATCC 6538);
4) After 18 hrs the incubation was stopped, after which the antimicrobial performance was determined.

The inoculum is a nutrient medium (agar) comprising the bacteria in a specified concentration according to Japanese Industrial Standard (JIS) 'Testing for antibacterial activity and efficacy on textile products' [reference number: JIS L 1902:2002 (E) page: 11; 8.1.2 preparation of test inoculum, b) Inoculum for quantitative test (absorption method)].

The inoculum prepared is put on the test piece at several points. And the test piece itself is in a vial (For further details see JIS L 1902:2002 page: 20; 10.1.3 Test operation & 10.1.2 Sterilization of test piece).

The following was determined:

Ma: Average of common log of number of living bacteria of 3 test pieces immediately after inoculation of inoculum on standard cloth Mb: Average of common log of number of living bacteria of 3 test pieces after 18-hour incubation on standard cloth Mc: Average of common log of number of living bacteria of 3 test pieces after 18-hour incubation on antibacterially treated sample.

From these experimental data the growth value (F), the bacteriostatic activity value (S) and the bactericidal activity value (L) were derived.

These are defined as follows:

$$F(\text{growth value})=Mb-Ma$$

The growth value is derived to determine whether the test was effective. If F>1.5 then the test is considered to be effective and the bacteriostatic and bactericidal activity value were calculated.

If F<=1.5 then the test is to be repeated.

The activity tests showed that the bacteria sample used was active.

$$S(\text{bacteriostatic activity value})=Mb-Mc$$

Inoculation of bacteria on the textile product treated with antibacterial finish and on the standard cloth, followed by counting the number of living bacteria after culture, and the numerical difference of living bacteria between the treated product and standard cloth shows the bacteriostatic activity value.

$$L(\text{bactericidal activity value})=Ma-Mc$$

Inoculation of bacteria on the textile product treated with bacteria-control finish and on the standard cloth, followed by counting the number of living bacteria after culture, and the numerical difference between the number of inoculated bacteria and that of the living bacteria on the treated product shows the bactericidal activity value.

The Bacterium Kill was determined as follows:

{(Number of bacteria in the standard cloth at 0 hr−Number of bacteria in the antibacterially treated cloth after 18 hr)/Number of bacteria in the standard cloth at 0 hr}×100%.

The results are evaluated as follows:

A Bacteriostatic Activity Value≧2.0 indicates the product can inhibit the growth of bacteria.

A Bactericidal Activity Value≧0 indicates that the product can suppress the growth of bacteria.

In the test using reference sole plate 1, the steam function was switched off; practically it was used as a dry iron. A Bacteriostatic value of 0, a Bactericidal value of <−1 and no bacterium kill was determined after 18 hrs of incubation.

Tests were performed using soleplates S2-S4 under steaming and dry conditions and using the same amount of strokes as for the reference.

In comparative tests, sole plate S2 gave better antimicrobial results than soleplate S3.

For sole plate S2 both steam and dry tests resulted in a Bacteriostatic value of >2 and a Bactericidal value of >0. For sole plate S2 both steam and dry tests resulted in a Bacterium Kill of >90%.

Some Bacteriostatic activity was observed for soleplate S4, the garment was evaluated as being refreshed.

A piece of cloth ironed using soleplate S2 was determined to comprise approximately 0.004 microgram Ag/cm2 on its ironed surface.

Summarising, the invention relates to an iron comprising a soleplate having a garment-contact surface and having a means for accommodating an anti-microbial agent, wherein the means is formed at least by the garment-contact surface accommodating the antimicrobial agent, which garment-contact surface is capable of transferring the antimicrobial agent to a piece of garment. In a practical embodiment said means has a layer comprising the antimicrobial agent, the layer having the garment-contact surface.

The invention claimed is:

1. An iron comprising a soleplate having a garment-contact surface, the soleplate further having a means for accommodating an antimicrobial agent, wherein the means comprises the garment-contact surface accommodating the antimicrobial agent, which garment-contact surface is arranged for transferring the antimicrobial agent to a piece of garment in response to (i) placing the iron on a garment to establish a required surface contact between the garment-contact surface of the soleplate and a surface of the garment and (ii) moving the iron over the garment surface, wherein a quantity of antimicrobial agent is transferred from the soleplate to the garment via movement of the garment-contact surface in contact with and over the garment surface.

2. The iron according to claim 1, wherein the means comprises a layer that comprises the antimicrobial agent, the garment-contact surface being a surface of the layer.

3. The iron according to claim 2, wherein the layer further comprises a carrier that comprises the antimicrobial agent.

4. The iron according to claim 3, further wherein the carrier is a zeolite.

5. The iron according to claim 1, wherein the antimicrobial agent is selected from a group consisting of ions of silver, zinc, copper, selenium, platinum, and a combination thereof.

6. The iron according to claim 1, wherein the soleplate is made from a material comprising at least 0.05 weight percent of the antimicrobial agent.

7. The iron according to claim 2, wherein the layer further comprises at least 0.05 weight percent of the antimicrobial agent.

8. The iron according to claim 2, wherein the layer further comprises a thermoplastic polymer.

9. The iron according to claim 2, wherein the layer further comprises a sol-gel or enamel material.

10. Soleplate suitable for use in an iron according to claim 1 and defined in claim 1, said soleplate having a garment-contact surface and having a means for accommodating an anti-microbial agent, wherein the means is formed at least by the garment-contact surface accommodating the antimicrobial agent, which garment-contact surface is capable of transferring the antimicrobial agent to a piece of garment.

11. A steam ironing device comprising a steam generating means and an iron according to claim 1, the soleplate comprising at least one steam outlet opening and the steam generating means being arranged for delivering steam to said opening.

12. Method of manufacturing a soleplate for an iron, wherein the soleplate has a garment-contact surface and a layer comprising an antimicrobial agent, the layer having the garment-contact surface, which garment-contact surface is capable of transferring the antimicrobial agent to a piece of garment in response to (i) placing the iron on a garment to establish a required surface contact between the garment-contact surface of the soleplate and a surface of the garment and (ii) moving the iron over the garment surface, wherein a quantity of antimicrobial agent is transferred from the soleplate to the garment via movement of the garment-contact surface in contact with and over the garment surface, the method comprising the step of providing the layer that comprises the antimicrobial agent to the soleplate.

* * * * *